United States Patent [19]

Huseby et al.

[11] Patent Number: 4,794,859

[45] Date of Patent: Jan. 3, 1989

[54] ACTIVE PAPER DROP FOR PRINTERS

[75] Inventors: William R. Huseby; Kevin L. Moon; Steve O. Rasmussen; Larry A. Jackson, all of Vancouver, Wash.

[73] Assignee: Hewlett-Packard Company, Palo Alto, Calif.

[21] Appl. No.: 113,041

[22] Filed: Oct. 23, 1987

[51] Int. Cl.[4] ..... B41F 21/00

[52] U.S. Cl. ..... 101/485; 101/419; 271/213; 400/126

[58] Field of Search ..... 101/426, 416 R, 417, 101/418, 419, 420; 271/213; 400/126

[56] References Cited

U.S. PATENT DOCUMENTS

| | | | |
|---|---|---|---|
| 2,647,463 | 8/1953 | Ferrar | 101/419 |
| 2,850,214 | 9/1958 | Rooney, Jr. | 101/416 R |
| 3,029,731 | 4/1962 | Bussey | 101/419 |
| 4,112,469 | 9/1978 | Paranjpe et al. | 400/126 |
| 4,575,729 | 3/1986 | Ayers et al. | 400/126 |
| 4,694,307 | 9/1987 | Toganoh et al. | 400/126 |

*Primary Examiner*—Eugene H. Eickholt
*Attorney, Agent, or Firm*—S. A. Kassatly; Bloor Redding, Jr.

[57] ABSTRACT

An active paper drop mechanism (20) for ink-jet printers is provided. The mechanism comprises a pair of opposed, movable rail members (22) associated with opposed walls (14) of a horizontal-disposed output collection tray (12) for receiving sheets (10) of printed media.

In particular, each rail member is provided with return spring (26) that act to maintain the rails in a closed position. In that position, the rails support a sheet of the print medium during the printing operation, thus giving the ink on the previously printed-on sheet (10') time to dry.

The rails are provided with a wing member (32) and are pivotally secured (38) in the floor of the output tray, with the pivot point spaced inwardly from the wing member. Downward pressure against the wing member thus causes the rail to rotate outward from its closed position, into a recess (24) provided in the side of the output tray. This provides sufficient clearance for the sheet to drop into the output stack. Upon release of the downward pressure, the spring causes the rail member to return to its original closed position.

26 Claims, 2 Drawing Sheets

ACTIVE PAPER DROP FOR PRINTERS

TECHNICAL FIELD

The present invention relates to ink-jet printers, and, more particularly, to a paper-handling mechanism that permits drying of paper or other print media without requiring drying mechanisms.

BACKGROUND ART

Common ink-jet printers print in the vertical plane; that is, paper is fed up through the print zone by means of a drive roller onto a platen. The paper is vertically stacked in an output tray.

In a radical shift from printing in the vertical plane, new ink-jet printers are under development which print in the substantially horizontal plane. Typically, paper is fed from an input paper tray through the print zone by means of a drive roller onto a platen. In this configuration, the paper is horizontally stacked in an output tray.

Such horizontally-printing ink-jet printers must deal with the problem of ink drying, unless specially coated paper is employed. If no mechanism is provided for drying the ink, then, with rapid output of paper, one sheet is placed in the paper output tray before the ink on the sheet underneath has had a chance to dry, thereby causing smearing of the print on the lower sheet.

One common mechanism is to provide some sort of drying means, such as a lamp or heater. However, such a requirement also adds to the complexity of the printer, since a power source, lamp or other heating device, and associated apparatus must be provided. Such apparatus also adds to the weight and cost of the ink-jet printer.

One approach to avoid the foregoing problems is to provide a passive drop scheme. In this approach, paper emerging from the print zone of the printer is guided along rails that suspend the paper above the output tray. At the completion of printing, the paper simply drops of its own weight into the paper tray, with the previously-printed sheet underneath having had an opportunity to air-dry during the printing of the next sheet.

While this is a satisfactory approach, it experiences occasional hang-ups, due to a phenomenon known as cockling. As is well-known, paper printed on one side cockles; that is, it becomes corrugated and stiff. As a consequence, rather than dropping into the output tray, the paper tends to get pushed off the rails onto the printer stand or floor by subsequent sheets. This cockling effect becomes more pronounced with environmental extremes and large amounts of ink on the paper.

It is desired to reduce the cost and complexity of handling paper with wet ink generated by ink-jet printers, while simplifying the components and their interactive association. It is also desired to handle paper stacking problems created by paper cockling.

DISCLOSURE OF INVENTION

In accordance with the invention, an active paper drop mechanism is provided for ink-jet printers printing in a substantially horizontal plane and including an output collection means for receiving a plurality of sheets of a print medium upon printing of each said sheet. The mechanism comprises a pair of opposed, movable rail members. Each side rail member is cooperatively associated with one side of the print medium and is provided with (a) means for moving from an initial, closed, sheet-supporting position to a spacing such that the sheet is no longer supported and (b) means for returning the member to the initial position.

In a preferred embodiment, each rail member is provided with return spring means that act to maintain the rails in a closed position. In that position, the rails support a sheet of the print medium during the printing operation, thus giving the ink on the previously printed-on sheet time to dry.

The rails are provided with a wing member and are pivotally secured in the floor of the output collection means, with the pivot point spaced inwardly from the wing member. Downward pressure against the wing member thus causes the rail to rotate outward from its closed position, into a recess provided in the side of the output tray. This provides sufficient clearance for the sheet to drop into the output stack. Upon release of the downward pressure, the spring means causes the rail member to return to its original closed position.

In one embodiment, a platen support member, which is associated with a platen upon which the sheet of print medium is supported during the print operation, rotates downwardly after printing that sheet. The platen support member is provided with an ear member that engages the wing member during its downward travel, thereby forcing the rail members into the open position.

In the closed, or extended, position, the rail members provide support for a sheet of print medium. In the open position, the sheet of print medium drops of its own weight into the output collection means, by which time, a previously-printed sheet of the print medium has air-dried. By supporting the sheet from underneath, no paper-handling mechanism contacts the freshly-printed upper side of the sheet, also avoiding smearing of the ink.

BEST MODES FOR CARRYING OUT THE INVENTION

The ink-jet printer (not shown) is of the type which prints a print medium 10 in the substantially horizontal plane, as compared with more common printers which print in the vertical plane. Printing in the horizontal plane entails stacking the print medium 10 in a horizontal output collection means or tray 12. Such an output tray is provided with a pair of spaced apart, opposed side wall members 14*a,b*.

Figure 1:
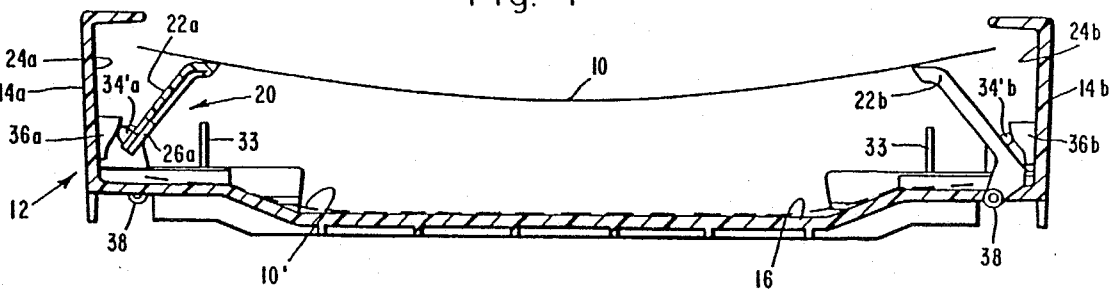
FIG. 1 is a cross-sectional view of a print medium output tray, with the rail members in the closed position, supporting a sheet of the print medium.
Figure 2:
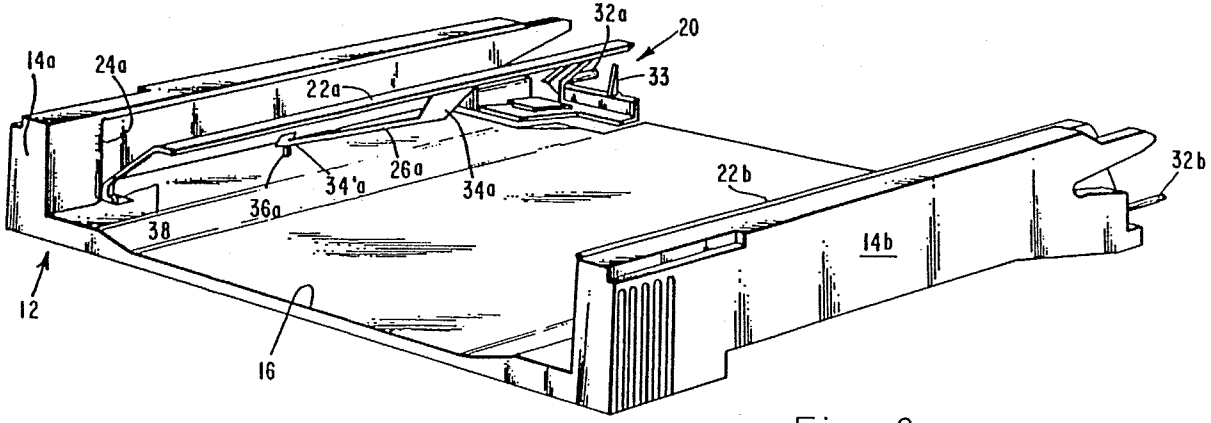
FIG. 2 is a perspective view, showing the print medium output tray and the rail members in the closed position.

The wall members 14*a,b* are maintained in the spaced-apart configuration by a floor member 16, upon which the print medium 10 is stacked when printed, as indicated by dashed line 10' in FIG. 1. The input paper tray, the print cartridge, means for moving the print cartridge bidirectionally, means for moving the print medium from the input paper tray through the print zone and into the output paper tray, and means for controlling the foregoing operations are not depicted herein, since these items are known.

In accordance with the invention, an active paper drop mechanism, denoted generally at 20, is provided for handling paper 10 during printing and stacking the paper after it has been printed on. In a particular embodiment, as a sheet of paper 10 is being printed on, it must not touch any previously printed-on sheets 10'. The invention permits the ink to dry on the sheets 10' that have previously been printed on and stacked.

As the current sheet of print medium 10, e.g., paper, is printed on, it is fed into position for ejection over the already printed-on sheets 10' in the output tray 12. The paper handling means 20 of the invention comprises a pair of opposed, spaced-apart rail members *22a,b*, which, in a closed position, support the current sheet 10 and keep it elevated above the output stack 10'. Each side rail member *22a,b* is thus cooperatively associated with one side of the print medium, along an edge thereof.

To eject the sheet 10, the rail members *22a,b* are moved out of the way, such as by pivoting, to an open position, and the sheet drops onto the output stack.

The rail members *22a,b* fit into recesses *24a,b* provided in the vertical wall members *14a,b*. When the rail members *22a,b* are in the recesses, the rail members are considered to be in the open position. A means *26a,b* of returning the side rail members *22a,b* to the initial, closed position is provided. Thus, only an opening motion needs to be provided. Such opening motion may be supplied by a pivoting platen support 28, shown in FIGS. 3, *5a–b*, which is associated with a platen (not shown). The platen supports the sheet 10, particularly in the print zone, during printing. On each end of the pivoting platen support 28 is an ear 30, each of which engages a wing *32a,b* of the rails *22a,b* to force the rails into the open position.

At the termination of printing of the sheet 10, at which time the bottom edge of the sheet is still supported by the platen, the platen support 28 and the platen both pivot downwardly to remove support from beneath the bottom edge of the sheet.

Snouts 33 prevent the sheet 10 from feeding back under the platen. The snouts 33 are formed as a part of the floor 16 of the output tray 12.

The return means may comprise a return spring *26a,b*, built onto each rail member *22a,b*, which tends to push the rail member back into the closed position.

The spring motion may be achieved by a variety of ways, such as with coil or leaf springs and the like. In a preferred embodiment, each side rail member 22 is provided with a downwardly depending, L-shaped peninsular, or cantilevered, member 34, which is fabricated as an integral piece with the side rail member and is provided with an outward bow, which causes some preloading force in the closed position. The free end 34' of the cantilevered member 34 bears against a stud member 36 at all times. The stud member 36 is formed as an integral part of the inner wall of the side member 14.

In the open position, the cantilevered member 34 assumes a nearly straight (deflected) configuration, but, desiring to return to the bowed (undeflected) configuration, exerts pressure against the stud member 36 to urge each side rail member 22 to return to the closed position. Such return, however, is prevented so long as the ear 30 is in contact with the wing member 32. On the other hand, once such contact is released, the side rail members *22a,b* return to their closed position.

The side rail members *22a,b* are pivotally secured at each end thereof in the floor 16 of the output tray 12. The side rail members rotate about a pivot point 38, which is spaced inwardly from the wing member 32.

Figure 3:
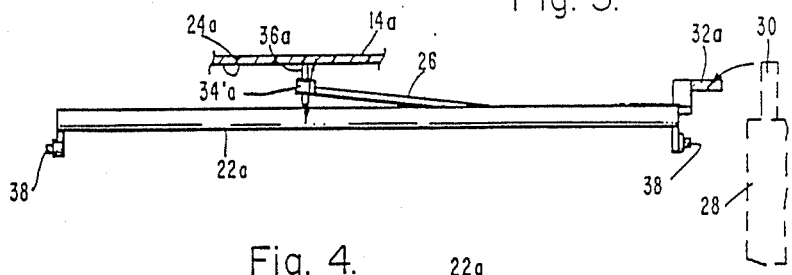
FIG. 3 is a top plan view, illustrating the motion of a rail member upon activation.
Figure 4:
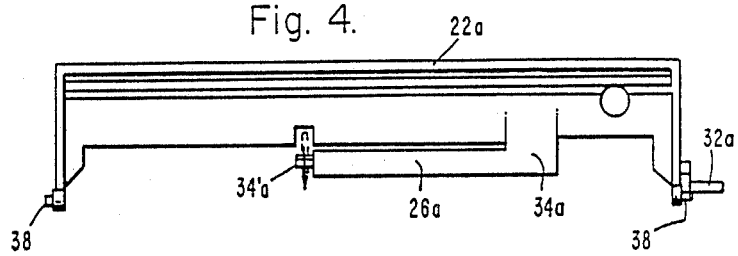
FIG. 4 is a side elevational view of the rail member.
Figure 5A:
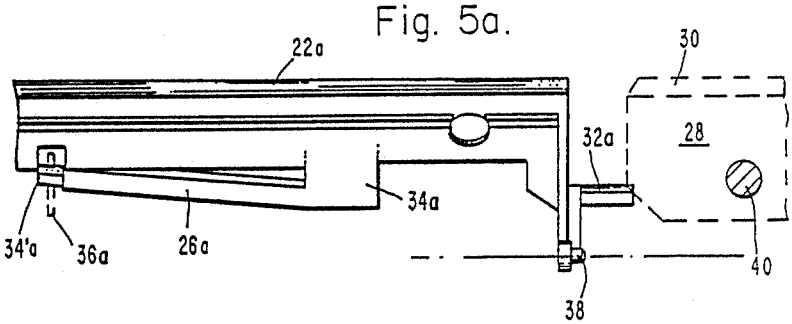
FIG. 5*a* is a partial side elevational view similar to that of FIG. 4, enlarged to illustrate the mechanism of motion.
Figure 5B:
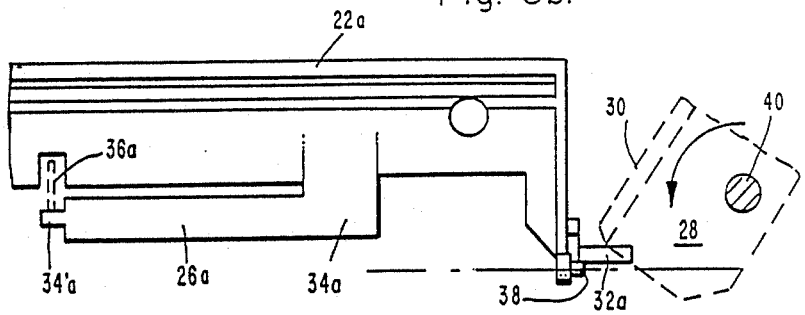
FIG. 5*b* is a view similar to that of FIG. 5*a*, further illustrating the mechanism of motion.

As seen in FIG. 3, downward rotation of the platen support 28 and its associated ear member 30 into the plane of the drawing causes engagement of the wing member 32 on the side rail member 22. Such motion causes the wing member 32 to pivot about the pivot point 38, forcing the side rail member 22 into the recess 24. Thus, the side rail member 22 is in the open position.

Upon disengagement of the wing member 32 by the ear 30, that is, upon upward motion of the rotating platen support 28 to its original position, the force exerted by the cantilevered member 34 causes the side rail member 22 to return to its original closed position.

FIGS. *5a,b* depict the mechanism of the motion, with FIG. *5a* showing the platen support 28 in its original position and the side rail member 22 in its original, closed position, with the cantilevered member 34 in its preferred bowed state. FIG. *5b* shows the platen support 28 having rotated downwardly about a shaft 40. Although not visible in FIGS. *5a,b*, the ear member 30 engages the wing member 32, forcing the side rail member 22 outwardly. It will be observed that the cantilevered member 34 has deflected to a nearly straight configuration.

Of course, other means may be used to depress the wing members *32a,b* where a rotating platen support (or rotating platen) is not employed. Typically, the printer will include means (not shown) for detecting the end, or bottom edge, of the sheet 10. A coupling of such detection means to the wing members 32a,b could alternatively be employed.

The main advantages provided by the active paper drop mechanism of the invention are three-fold. First, the side rail members *22a,b* keep the sheet 10 of print medium being printed on from touching the wet ink of a previously printed sheet 10' until the ink is dry. Second, the current sheet 10 is elevated by the use of rail members *22a,b* on the under side of the sheet. Therefore, nothing contacts the side being printed on, so that smearing of the wet ink is avoided by the paper handling mechanism 20 of the invention. Third, sheets 10 of the print medium drop into the output tray 12 regardless of the amount of stiffening due to cockling.

INDUSTRIAL APPLICABILITY

The active paper drop mechanism of the invention is suitably employed in ink-jet printers utilizing printing in the substantially horizontal plane and consequent horizontal stacking of printed-on print medium.

Thus, an active paper drop mechanism is provided for supporting individual sheets of a print medium during printing to prevent smearing of wet ink of previously-printed sheets. It will be apparent to one of ordinary skill in the art that various changes and modifications of an obvious nature may be made without departing from the spirit and scope of the invention, and all such changes and modifications are deemed to fall within the scope of the invention as defined by the appended claims.

What is claimed is:

1. An active paper drop mechanism (20) for an ink-jet printer printing in a substantially horizontal plane, said printer including an output collection means for receiving a plurality of sheets (10') of a print medium upon printing of each said sheet (10), said active paper drop mechanism comprising a pair of opposed, spaced-apart side rail members (22), each side rail member cooperatively associated with one side of said print medium and provided with (a) means for moving said member from an initial closed, sheet-supporting position to an open position wherein said sheet is no longer supported and (b) means for returning said member to said initial position.

2. The mechanism of claim 1 wherein said output collection means comprises an output tray (12) comprising a floor (16) to receive said sheets.

3. The mechanism of claim 2 wherein said output tray is further provided with a pair of opposed, spaced apart side wall members (14) separated by said floor.

4. The mechanism of claim 1 wherein said movement means comprises a rotational movement, each side rail member pivotally secured by a pivot means (38).

5. The mechanism of claim 4 wherein each said side rail member is provided with an engageable wing member (32) spaced outwardly from said pivotal securement for permitting said side rail member to rotate outward from said initial closed, sheet-supporting position.

6. The mechanism of claim 5 further comprising means (30) for engaging said wing member upon termination of printing of said sheet.

7. The mechanism of claim 6 wherein said engaging means comprises an ear member (30) associated with a downwardly pivoting platen support (28) associated with a platen for supporting said sheet of print medium during printing.

8. The mechanism of claim 1 wherein said return means comprises a spring (26).

9. The mechanism of claim 8 wherein said spring means comprises a cantilevered member (34), integrally formed as a part of said side rail member.

10. An active paper drop mechanism (20) for an inkjet printer printing in a substantially horizontal plane, said printer including an output tray (12) comprising a floor (16) to receive sheets (10') of a print medium upon printing of each said sheet (10), wherein said output tray is provided with a pair of opposed, spaced-apart side wall members (14) separated by said floor, said active paper drop mechanism comprising a pair of opposed, spaced-apart side rail members (22), each side rail member cooperatively associated with one side of said print medium and provided with means for returning to said initial position.

11. The mechanism of claim 10 wherein said movement means comprises a rotational movement, each side rail member pivotally secured by a pivot means (38).

12. The mechanism of claim 11 wherein each said side rail member is provided with an engageable wing member (32) spaced outwardly from said pivotal securement for permitting said side rail member to rotate outward from said initial closed, sheet-supporting position.

13. The mechanism of claim 12 further comprising means (30) for engaging said wing member upon termination of printing of said sheet.

14. The mechanism of claim 13 wherein said engaging means comprises an ear member (30) associated with a downwardly pivoting platen support (28) associated with a platen for supporting said sheet of print medium during printing.

15. The mechanism of claim 10 wherein said return means comprises a spring (26).

16. The mechanism of claim 15 wherein said spring means comprises a cantilevered member (34), integrally formed as a part of said side rail member.

17. The mechanism of claim 16 wherein said cantilevered member terminates in a free end (34') and each said side wall member is provided with a recess (24) including a stud member (36) against which said free end bears.

18. An active paper drop mechanism (20) for an inkjet printer printing in a substantially horizontal plane, said printer including an output tray (12) for receiving a plurality of sheets (10') of a print medium upon printing of each said sheet (10), said output tray provided with a pair of opposed, spaced-apart side wall members (14) separated by a floor (16), said active paper drop mechanism comprising a pair of opposed, spaced-apart side rail members (22), each side rail member cooperatively associated with one of said side wall members and provided with a spring means (26) bearing against said side wall member, each side rail member pivotally secured by pivot means (38) in said floor of said output tray and provided with an engageable wing member (32) spaced outwardly from said pivotal securement for permitting said side rail members to rotate outward from an initial closed, sheet-supporting position.

19. The mechanism of claim 18 wherein said spring means comprises a cantilevered member (34), integrally formed as a part of said side rail member and provided with an outward bow.

20. The mechanism of claim 19 wherein said cantilevered member terminates in a free end (34') and said side wall member is provided with a recess (24) including a stud member (36) against which said free end bears.

21. The mechanism of claim 18 further comprising means (30) for engaging said wing member upon termination of printing of said sheet.

22. The mechanism of claim 21 wherein said engaging means comprise an ear member (30) associated with a downwardly pivoting platen support (28) associated with a platen for supporting said sheet of print medium during printing.

23. An active paper drop mechanism (20) for an inkjet printer printing in the horizontal plane, said printer including an output tray (12) for receiving a plurality of sheets (10') of a print medium upon printing of each said sheet (10), said output tray provided with a pair of opposed, spaced-apart side wall members (14) separated by a floor (16), said active paper drop mechanism comprising a pair of opposed, spaced-apart side rail members (22), each side rail member cooperatively associated with one of said side wall members and provided with a spring means (26) bearing against a portion (36) of said side wall member, said spring means comprising a cantilevered member (34), integrally formed as a part of said side rail member, said cantilevered member provided with an outward bow and terminating in a free end portion (34') which bears against said portion of said side wall member, each side rail member pivotally secured by pivot means (38) in said floor of said output tray and provided with an engageable wing member (32) spaced outwardly from said pivotal securement for permitting said side rail members to rotate outward from an initial closed, sheet-supporting position.

24. The mechanism of claim 23 further comprising means (30) for engaging said wing member upon termination of printing of said sheet.

25. The mechanism of claim 24 wherein said engaging means comprise an ear member (30) associated with a downwardly pivoting platen support (28) associated with a platen for supporting said sheet of print medium during printing.

26. An improved method for stacking printed sheets of a print medium in a substantially horizontally-disposed output collection means during printing by an ink-jet printer, comprising (a) suspending a single sheet above said output collection means during said printing of said sheet by retractable means in a sheet-supporting position, (b) causing said retractable means to retract at the termination of printing of said sheet to permit said sheet to drop onto said output collection means, thereby avoiding smearing of ink on a previously-printed sheet of said print medium, and (c) causing said retracting means to return to said sheet-supporting position.

* * * * *